United States Patent [19]

Traumüller et al.

[11] Patent Number: 4,568,127

[45] Date of Patent: Feb. 4, 1986

[54] CUTTING HEAD FOR DRIFT ADVANCING MACHINES

[75] Inventors: Gottfried Traumüller; Wilfried Maier, both of Zeltweg; Franz Schöffmann, Leoben; Herwig Wrülich, Zeltweg, all of Austria

[73] Assignee: Voest-Alpine Aktiengesellschaft, Vienna, Austria

[21] Appl. No.: 526,278

[22] Filed: Aug. 25, 1983

[30] Foreign Application Priority Data

Sep. 3, 1982 [AT] Austria ..... 3311/82

[51] Int. Cl.[4] ..... E21B 10/60; E21L 7/08; E21F 5/02

[52] U.S. Cl. ..... 299/81; 299/79

[58] Field of Search ..... 299/81, 79

[56] References Cited

U.S. PATENT DOCUMENTS

| | | | |
|---|---|---|---|
| 3,563,324 | 2/1971 | Lauber | 299/81 |
| 4,289,357 | 9/1981 | Hintermann et al. | 299/81 |

FOREIGN PATENT DOCUMENTS

| | | | |
|---|---|---|---|
| 2242558 | 5/1975 | France | 299/81 |
| 996962 | 3/1965 | United Kingdom | 299/81 |
| 1110763 | 4/1968 | United Kingdom | 299/81 |

*Primary Examiner*—Stephen J. Novosad
*Assistant Examiner*—M. Goodwin
*Attorney, Agent, or Firm*—Cushman, Darby & Cushman

[57] ABSTRACT

The cutting head (1) has passages (14, 16; 22) extending through the cutting head in axial direction thereof and being connected with the axial water supply bore (8) by radial bores (9). Radial bores leading to the outlet nozzles open into the passages (14, 16; 22) extending through the cutting head in axial direction thereof. The passages (14, 16; 22) extending through the cutting head in axial direction thereof can be closed at at least one side by means of detachable closure members (15), so that these passages (14, 16; 22) extending through the cutting head in axial direction thereof can, after having removed the closure members, be cleaned by means of a cleaning-rod.

5 Claims, 4 Drawing Figures

Figure 1:
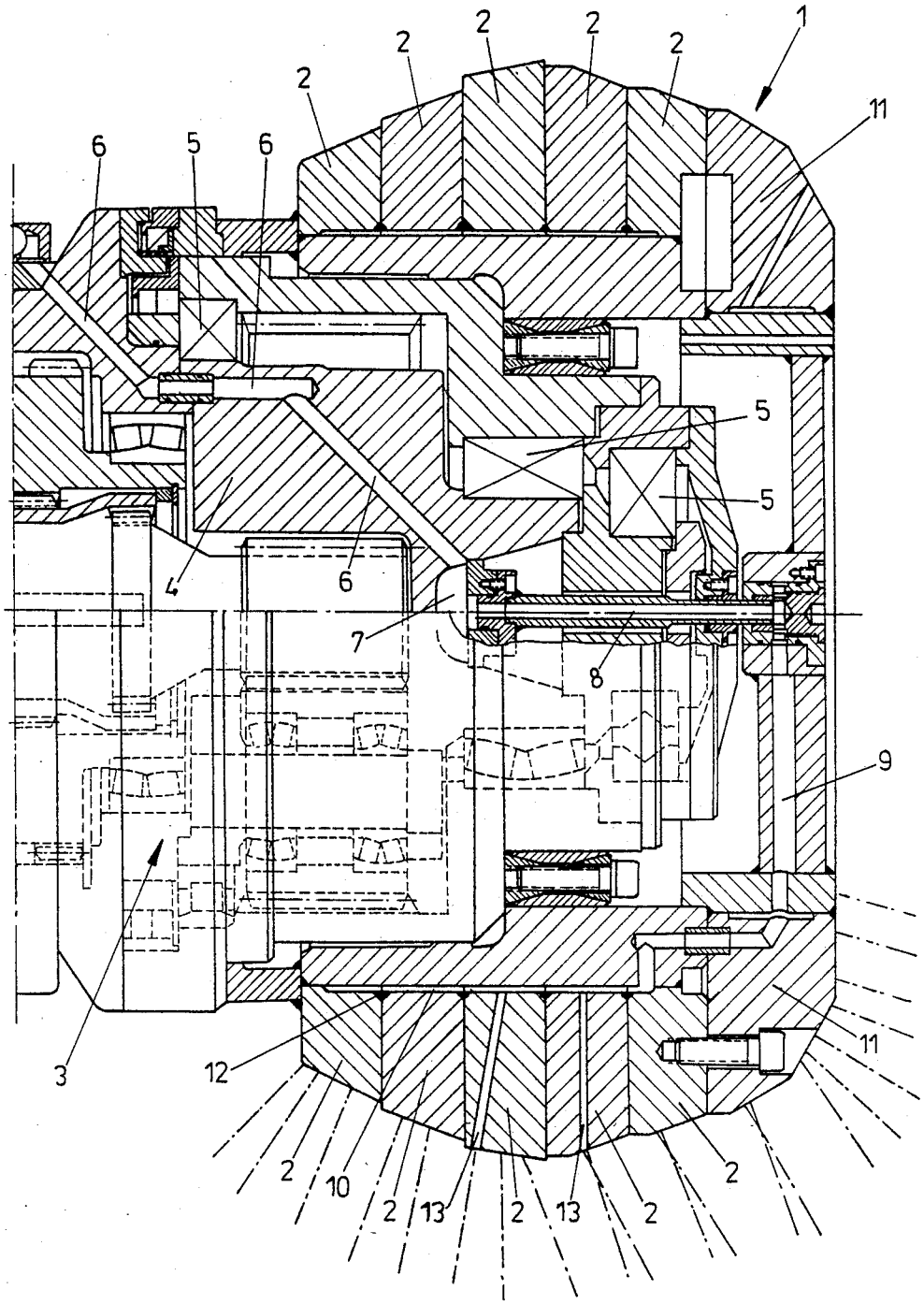
FIG. 1 PRIOR ART

FIG. 2
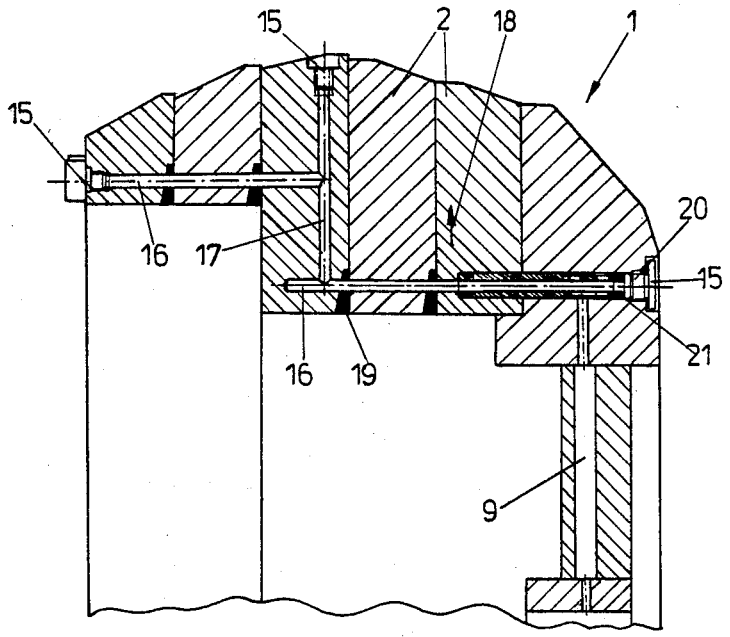
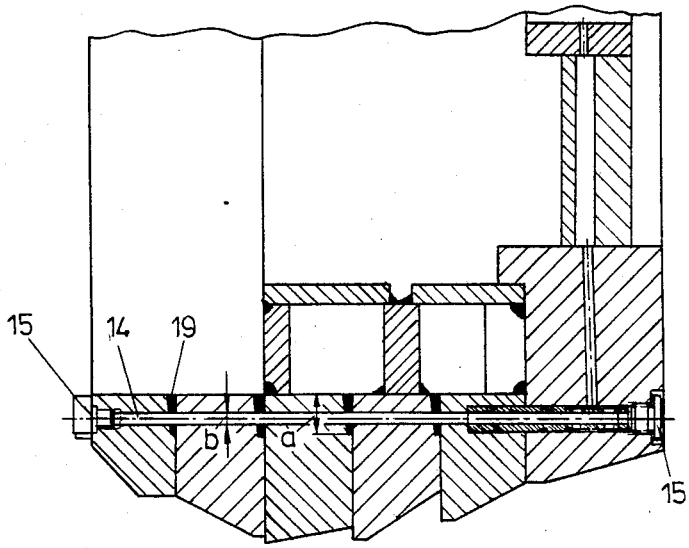
FIG. 3

CUTTING HEAD FOR DRIFT ADVANCING MACHINES

The invention refers to a cutting head for drift advancing machines and comprising bits arranged on its circumference and having outlet nozzles for the discharge of cooling water, which outlet nozzles can be supplied with water via passages extending within the cuttig head in axial direction thereof. The outlet nozzles for the discharge of cooling water can also be used to spray water for the purpose of dust-precipitation, and a plurality of constructions have become known in which such outlet nozzles are connected to the bit holder. With these constructions, supply of water can be shut off or given free by means of valves cooperating with the bits but also other control equipment can be used for controlling the supply of water. In each case it is necessary to equip the cutting head base member with corresponding passages to make possible supply of water to the individual nozzles. For this purpose, an axial water supply passage is, as a rule, provided and AT-PS No. 359 453 discloses an embodiment in which distribution of water to the nozzles is effected via a substantially cylindrical annular cavity extending in axial direction of the cutting head. The cutting head base member consists in most cases of cheap ferritic constructional steel and is thus subject to corrosion. Furthermore the water to be sprayed in the mine is frequently not very pure so that the danger for the passages and bores extending within the cutting head to become contaminated is relatively great. As soon as contamination has reached an extent at which the bores become clogged, the cutting head becomes inoperable for the intended use and cleaning operation is extremely expensive with the known embodiments.

The invention now aims at providing a cutting head of the initially mentioned type with which it is possible to clean in a simple manner the cavities serving for the supply of water to the nozzles. For solving this task, the invention essentially consists in that the passages extending within the cutting head are designed as passages extending through the cutting head in axial direction thereof and being connected with the axially extending water supply bore by substantially radial bores, radial bores leading to the outlet nozzles opening into said passages, and in that the passages extending through the cutting head in axial direction thereof can be closed at at least one front surface of the cutting head by means of removable closure members. In view of the passages serving the purpose of distributing the water to the nozzles being designed as passages extending through the cutting head in axial direction thereof and opening into bores aligned with these passages, a cleaning-rod can be inserted after removal of the closure member or members, so that cleaning can be effected in this manner.

The closure member can in a particularly simple manner be formed of a front disc of the cutting head removably fixed to that front surface of the cutting head which is remote from the cutting arm. With such a construction, sealing of the passages becomes expensive with high water supply pressure. For high water supply pressure the arrangement is, therefore, in an advantageous manner such that the passages extending through the cutting head in axial direction thereof open at least at one front or rear surface of the cutting head into at least one bore aligned with these passages, each bore being closable by means of a separate detachable closure member. With such an embodiment, bores aligned with the axial passages are preferably provided at both front and rear surfaces of the cutting head, so that dust particles can by means of a cleaning-rod be pushed through the whole length of the bores and can be expelled by the cleaning-rod at the respective opposite front surface.

Cleaning can be effected in a particularly satisfactory manner if the passages serving the purpose of distributing the water over the radial outlet nozzles are designed as bores extending over the whole axial length of the cutting head, because with such a construction the walls of the passages designed as bores can totally be cleared on account of the constant internal diameter of the passages.

Figure 4:
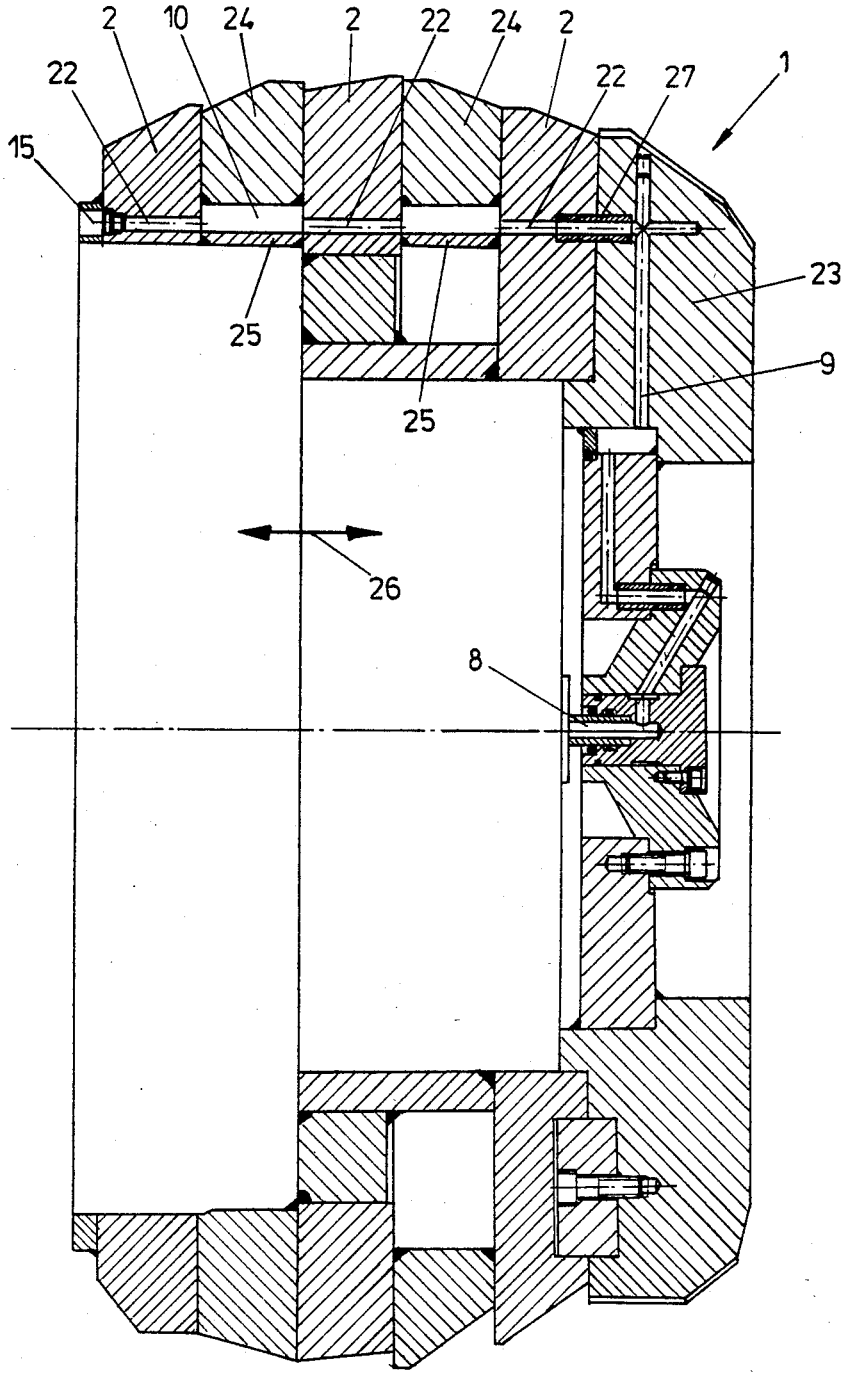

In the following, the invention is further explained with reference to embodiments shown in the drawing in which FIG. 1 is a cross section through a cutting head of the prior art, FIG. 2 is an analogous section through an embodiment according to the invention, FIG. 3 is an analogous section through a second embodiment, and FIG. 4 is an analogous section through a third embodiment.

In FIG. 1, the cutting head 1 is composed of discs 2 being welded one with the other, the cutting head 1 being rotatably supported on a cutting arm not shown. The last stage of the reduction gear is shown in dashed lines and designated 3. The bearing support of the cutting head 1 on a carrier 4 connected with the cutting arm is effected by means of antifriction bearings 5.

The water supplied flows first via passages 6 within the carrier 4 and then into a distributing chamber 7 and subsequently via an axial supply conduit 8, which is correspondingly sealed, and via radial conduits 9 into the distributing cavities 10 extending in axial direction of the cutting head. The front plate 11 of the cutting head 1 is connected with the base member of the cutting head by means of screws. From the annular cavity 10 the water flows via substantially radial bores 13 to the outlet nozzles which can be housed within the bit holder.

In the embodiment according to FIG. 2 there are, in place of the annular cavity 10, provided at least three bores 14 extending through the cutting head in axial direction thereof and being closed at both sides by means of closure members 15. If required by the geometry of the cutting head, the arrangement can, as is shown in the upper part of FIG. 2, also be such that the bore 14 is subdivided into two bores 16 which are connected one with the other by means of a radial bore 17. Also with such an embodiment, cleaning of the bores 14 or, respectively, 16 can be effected after having removed the closure member 15. Supply of water to these bores 14 or, respectively, 16, of which at least three are distributed over the circumference of the cutting head 1, can be effected in a substantially analogous manner as in the embodiment according to FIG. 1 and is therefore not shown again.

The individual discs 2 are connected one with the other by welding with their front surfaces, noting that one respective disc 2 has a recess extending in radial direction indicated by the arrow 18, said recess extending over a partial area a. This partial area a is greater than the diameter b of the bores 14 and, respectively, 16 and is filled by melting an electrode when connecting the individual discs. The bores 14 and, respectively, 16 are now passed through the weld beads, which are designated 19, so that there results a smooth internal surface as the wall of the bore. The closure members 15 have a screw thread 20 which is screwed into a corresponding internal thread 21 at the front sides of the bores 14 and, respectively, 16. The essentially radially extending tap conduits 13 leading to the outlet nozzles shown in FIG. 1 open into these bores 14 and, respectively, 16. Such an embodiment is, on account of the lower pressure becoming effective in radial direction, also suitable for supplying pressurized water to the outlet nozzles under a pressure of up to 300 bar without running the risk to subject to mechanically excessive stress the weld beads 19 between adjacent annular discs 2.

In FIG. 3, there is shown a further embodiment of a cutting head 1 again being composed of individual discs. Supply of water is again effected via an axial supply conduit 8 shown with its end portion. The radial conduits leading to the distributing cavities 10 extending in axial direction of the cutting head are again designated 9. With this embodiment, discs 2 are provided with bores 22 extending through these discs, the disc 2 located adjacent the cutting arm again carrying a closure member 15. The front disc 23, within which extends the radial bore 9, forms a closure member at the other side of the passages 10. The discs 2 are connected one with the other with interposition of discs 24, noting that for limiting the passages in radially inward direction wall portions 25 are inserted by welding, said wall portions being subdivided for the reason of easier assembling in circumferential direction of the cutting head. The bores 22 of the discs 2 are in alignment in the axial direction, indicated by the arrow 26, of the cutting head and allow, as is equally the case with the embodiment according to FIG. 2, insertion of a cleaning-rod for the purpose of cleaning the passages 10.

The front plate 23 is releasably connected with the adjacent disc 2 of the cutting head with interposition of a sealing element 27, so that after having removed the front plate and the rearwardly located closure members 15 sediments can, in the same manner as with the through-bore 14 of FIG. 2, be pushed to the side opposite to the place of insertion of the cleaning-rod and thus be removed.

What is claimed is:

1. A cutting head for drift advancing machines having front and rear surfaces and bits arranged on its circumference, the cutting head comprising a plurality of disc-shaped elements welded together, the cutting head further comprising a plurality of outlet nozzles situated at the periphery for discharging a cooling fluid, means defining radially extending bores within the cutting head for supplying cooling fluid to the nozzles, the radial bores extending from a plurality of axially extending bores within the cutting head, said extending bores being open at one end of the cutting head and being closable by detachable closure members, said axially extending bores supplying cooling fluid to the radially extending bores, and an axial fluid supply bore within the cutting head for supplying cooling fluid to the axially extending bores.

2. Cutting head as claimed in claim 1, characterized in that the closure member is located at the front surface of the cutting head and formed of a detachably fixed front plate.

3. Cutting head as claimed in claim 1, characterized in that the bores extending through the cutting head in axial direction thereof are open at the front and rear surfaces of the cutting head and have internal threads into which the detachable closure members are screwed.

4. Cutting head as claimed in claim 1, characterized in that the bores extend through the entire cutting head in axial direction thereof.

5. A cutting head for drift advancing machines having front and rear surfaces and bits arranged on its circumference, the cutting head comprising a plurality of disc-shaped elements welded together, means defining a cooling fluid supply bore coaxial with the cutting head, means defining a plurality of axial bores in communication with the supply bore parallel to and spaced from the supply bore and extending the entire length of the cutting head and being open at one end with a detachable closure member, means defining a plurality of radial bores extending from said axial bores for supplying cooling fluid to a plurality of discharge nozzles.

* * * * *